US005251523A

United States Patent [19]

Fisher et al.

[11] Patent Number: 5,251,523

[45] Date of Patent: Oct. 12, 1993

[54] EXTRUDED PLASTIC CUTTING ASSEMBLY AND MACHINE

[75] Inventors: Harry M. Fisher, Whitestone; Stuart N. Fisher, Floral Park, both of N.Y.

[73] Assignee: Fisher Automation, Inc., Whitestone, N.Y.

[21] Appl. No.: 856,529

[22] Filed: Mar. 23, 1992

[51] Int. Cl.[5] ..... B26D 1/08; B26D 5/28; B26D 7/18

[52] U.S. Cl. ..... 83/98; 83/155.1; 83/210; 83/212; 83/391; 83/416; 83/468.6; 83/635; 83/694; 83/697; 83/821

[58] Field of Search ..... 83/98, 416, 155.1, 209, 83/210, 211, 212, 247, 261, 269, 367, 391, 440.1, 441.1, 444, 468.6, 569, 613, 635, 638, 694, 697, 821, 679

[56] References Cited

U.S. PATENT DOCUMENTS

| | | | |
|---|---|---|---|
| 1,119,610 | 12/1914 | Johnson | 83/613 X |
| 2,269,714 | 1/1942 | Fenton | 83/212 |
| 3,150,551 | 9/1964 | Spengler et al. | 83/694 X |
| 3,277,764 | 10/1966 | Henc | 83/679 |
| 3,483,780 | 12/1969 | Hudson | 83/155.1 X |
| 4,103,723 | 8/1978 | Carmichael | 83/694 X |
| 4,274,457 | 6/1981 | Nilsen | 83/694 X |
| 4,754,677 | 7/1988 | McKindary | 83/697 |

*Primary Examiner*—Hien H. Phan

*Assistant Examiner*—Raymond D. Woods

*Attorney, Agent, or Firm*—Galgano & Belkin

[57] ABSTRACT

A cutting machine for cutting elongated, extruded plastic articles includes a cutter assembly composed of a pair of side-by-side, plate-like cutting die bushings having a transverse article opening formed therethrough configured and dimensioned to accommodate the passage and guidance of an elongated extruded plastic article therethrough, and a thin, generally planar cutting blade having a cutting edge. The blade is supportable for reciprocable movement between the cutting die bushings for movement between an operative position in which the blade moves across the article opening so as to cut an article disposed therein and an inoperative position in which the blade is displaced from the article opening. The blade is supported for reciprocable movement by at least one support finger disposed on each side of the blade which serves to prevent buckling of the blade. The machine also includes feed means disposed in front of the cutter assembly for feeding plastic articles to and through the article opening of the cutting die bushings and a reciprocable dead stop means disposed behind the cutter assembly in general alignment with the article opening for movement between an operative position in which it moves into the path of and stops the advance of the article and an inoperative position in which it is removed from the path of the article.

11 Claims, 3 Drawing Sheets

EXTRUDED PLASTIC CUTTING ASSEMBLY AND MACHINE

BACKGROUND OF THE INVENTION

The present invention relates to an extruded plastic cutting assembly and machine. More particularly, it relates to such a cutter assembly and machine specifically intended for cutting profiles, tubing and other extruded plastic products.

Various types of cutting assemblies are used for cutting extruded plastic articles, such as profiles, tubing and the like, to length. In one prior art machine, an on-demand or a continuously-rotating circular cutting arm with a blade attached is used. However, if it is too thin, the cutting blade wanders as it performs its cutting action resulting in an uneven cut. If, on the other hand, the blade is too thick, it produces disadvantageous burrs. In this apparatus, the product is always moving and the cutting arm produces chatter upon rotation. The constant feeding operation is hard on the blade while the blade is engaged with the product, as a result of which the blade cannot be made too thin.

In another type of cutting apparatus, a shearing type cutting action is employed having one stationary blade and one moving blade, one of which is provided with a chamfer or angle. As a result of this construction, one side of the cutting action results in a clean cut while the other side results in an uneven cut which is waste and which, in turn, produces large amounts of scrap.

In many plastic extrusion facilities, the product is cut in as long a length as practical for handling. It is then cut to its smaller finished size "off-line" manually or semi-automatically utilizing circular saws, band saws, presses, etc.

Accordingly, it is an object of the present invention to provide a novel plastic profile cutting assembly and machine which allows thinner blades to be used and results in very fine cuts without any appreciable waste.

It is a further object of the invention to provide such a novel cutting assembly and machine which is relatively simple in design, highly efficient in operation, and relatively easy to manufacture and install.

It is a more particular object of the present invention to provide such a novel cutting assembly and machine which has a high degree of reliability and flexibility and reduces the need for any manual or semi-automatic "off-line" cutting operations, thus greatly increasing productivity.

SUMMARY OF THE INVENTION

Certain of the foregoing and related objects are readily attained in cutter assembly for cutting elongated extruded plastic articles which includes a pair of side-by-side, plate-like cutting die bushings having a transverse article opening formed therethrough configured and dimensioned to accommodate the passage and guidance of an elongated extruded plastic article therethrough, and a thin, generally planar cutting blade having a cutting edge. The blade is supportable for reciprocable movement between the cutting die bushings for movement between an operative position in which the blade moves across the article opening so as to cut an article disposed therein and an inoperative position in which the blade is displaced from the article opening. Support means are provided for supporting the cutting blade for reciprocable movement between the operative and inoperative positions thereof. The support means includes at least one support finger disposed on opposite sides of the blade spaced from the cutting edge thereof which serve to prevent buckling of the blade as the blade moves from its inoperative to its operative position.

Most advantageously, the cutter die bushings each have an elongated slot formed therein configured and dimensioned to receive a respective finger of the support means. Preferably, the support means has a pair of spaced-apart support fingers disposed on opposite sides of the blade and the bushings each having a pair of spaced-apart slots for receiving the pairs of fingers. Most desirably, the fingers and slots are each generally U-shaped and the blade has a V-shaped cutting edge.

Certain of the foregoing and related objects are also attained in a cutting machine for cutting elongated, extruded plastic articles which includes a cutter assembly as described above, a feed means disposed in front of the cutter assembly for feeding plastic articles to and through the article opening of the cutting die bushings, and a reciprocable dead stop means disposed behind the cutter assembly in general alignment with the article opening. The dead stop means is reciprocable for movement between an operative position in which it moves into the path of and stops the advance of the article and an inoperative position in which it is removed from the path of the article.

In a preferred embodiment of the invention, the feed means comprises a pair of co-acting rotatable feed rollers, one of which is motor driven. The machine advantageously includes conveyor means for transporting the plastic articles along a predetermined path from the cutter assembly to the dead stop means and means for reciprocating the cutting blade and the dead stop means. The means for reciprocating advantageously comprises air cylinders. The machine also desirably includes means for removing the articles from the conveyor. The means for removing may include air nozzle means for blowing the cut articles off the conveyor in a direction normal thereto.

Other objects and features of the present invention will become apparent from the following detailed description considered in connection with the accompanying drawings, which illustrate one embodiment of the invention. It is to be understood that the drawings are to be used for the purpose of illustration only, and not as a definition of the limits of the invention.

BRIEF DESCRIPTION OF THE DRAWINGS

Further advantages and details can be gleaned from the drawings, wherein similar reference numerals denote similar elements throughout the several views. In the drawings.

DETAILED DESCRIPTION OF THE PREFERRED AND ILLUSTRATED EMBODIMENT

Figure 1:
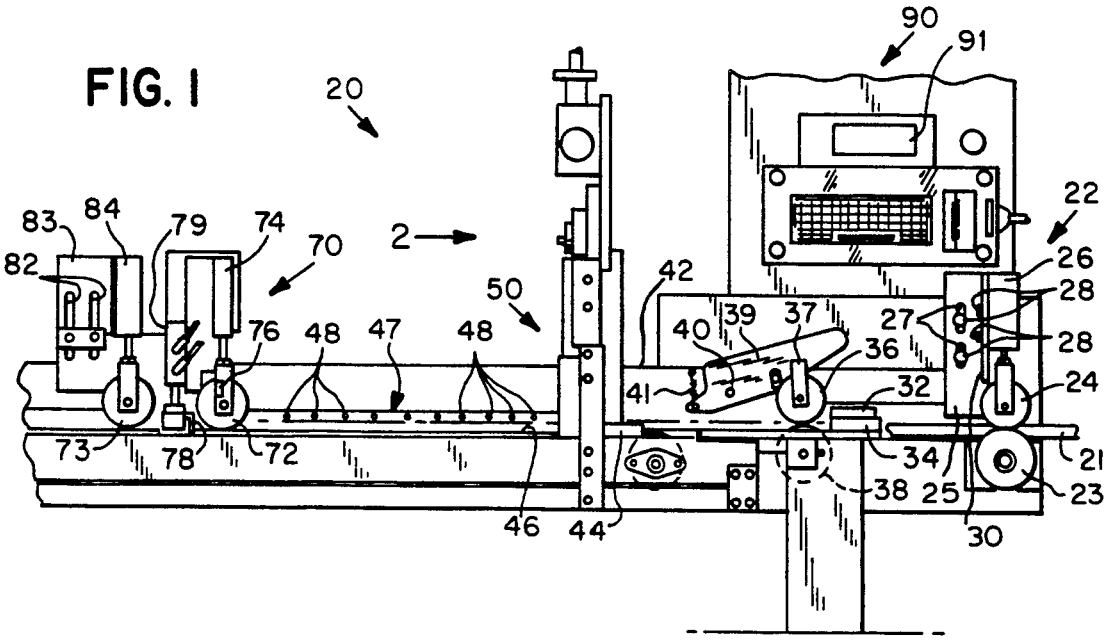
FIG. 1 is an isometric, partially schematic, side view of a novel machine embodying the present invention.

Turning now in detail to the appended drawings and, in particular, FIG. 1 thereof, therein illustrated is a novel cutting machine embodying the present invention, generally designated by reference numeral 20. Machine 20 is primarily intended for cutting plastic extrusions, profiles, tubes, and the like to length.

Typically, cutting machine 20 would be used "on-line" with the plastic extruder machine (not shown), but it could also be utilized "off-line" to cut long lengths of extruded plastic to finished length pieces. In "on-line" applications, the plastic is continually extruded into its intended shape be it a laminated product or perhaps a round single material tube. It is pulled from the extruder by a machine commonly referred to as a "puller" (not shown). After exiting the puller, it would enter the pre-feed system 22 of machine 20. Pre-feed system 22, and machine 20 are typically located at some distance from the "puller" so that a loop can form during the cut cycle of the machine. The more rigid the plastic extrusion, the further machine 20 should be located from the puller. A distance of from 2 to 10 feet should be adequate for most applications.

Pre-feed system 22 consists of a lower driven pull roller 23 which is powered by a variable speed motor (not shown) and a biased freely rotatable idler roller 24 that pushes extrusion 21 against roller 23. The speed of roller 24 would typically be adjusted to be capable of driving the extrusion 21 faster than it is provided to it by the puller, thus using up any loop that was formed between machine 20 and the puller. Roller 24 is given a downward force by a conventional air-adjustable air cylinder 26.

When the loop is used up between the puller and machine 20, slippage occurs between roller 23 and extrusion 21. By adjusting the downward pressure supplied by cylinder 26, the proper forward drive force can be achieved against the extrusion 21 without undue wear on roller 23.

Pre-feed assembly 22 is vertically adjustable by cooperating slots 27 and nuts 28 in support plates 25, 30. Roller 23 can be interchanged with a roller that has a profile to match the profile of a particular extrusion. This adjustability gives the machine as wide as possible adaptability for use with many different styles of extrusions with various cross-sections.

Next, extrusion 21 travels through adjustable guide elements 32, 34 which guide the extrusion straight toward the cutting die 50 assembly, as described in greater detail hereinafter.

Extrusion 21 then enters between rollers 36 and 38. Both rollers 36, 38 contain "one-way" bearings so that the extrusion can travel with little effort toward the dead stop and with a much higher effort if it wanted to go backwards; the purpose of which will be described in greater detail hereinafter.

Roller 36 is mounted on a hardened pin contained by setscrews in U-shaped support 37. Support 37 is affixed to support arm 39 which can pivot around a pivot screw 40. Roller 36 receives clockwise pivotal force due to a spring 41 which has one end attached to arm 39 and the other to a frame member 42.

Thereafter, extrusion 21 enters a guide 44 which has a tunnel for a conveyor belt 46 to pass on its bottom side. On its top side (not viewable) it has a U-shape to provide bottom and side guidance for the extrusion to enter the cutting assembly 50. This part could be changed to match different types of extrusions. For example, if a tube were to be cut, this part could contain a hole on its top side for guidance.

Figure 2:
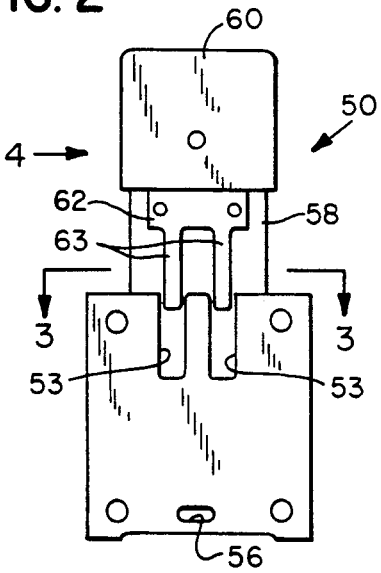
FIG. 2 is an enlarged view of the cutter assembly embodying the present invention taken in the direction of arrow 2 in FIG. 1.
Figure 3:
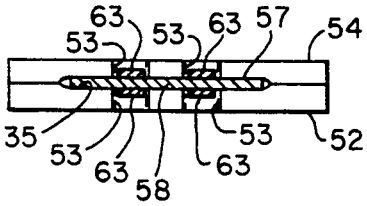
FIG. 3 is cross-sectional view taken along line 3 of FIG. 2.
Figure 4:
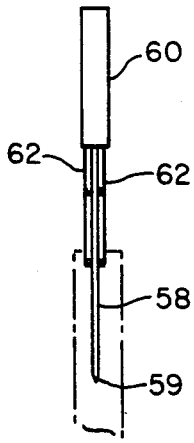
FIG. 4 is a side elevational view taken in the direction of arrow 4 in FIG. 2.
Figure 5:
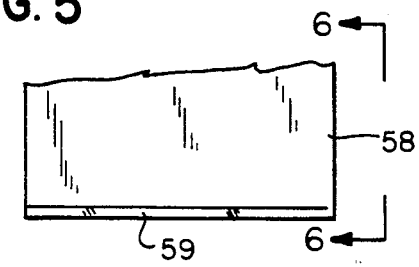
FIG. 5 is a fragmentarily-illustrated, enlarged view of the bottom portion of the cutting blade.
Figure 8:
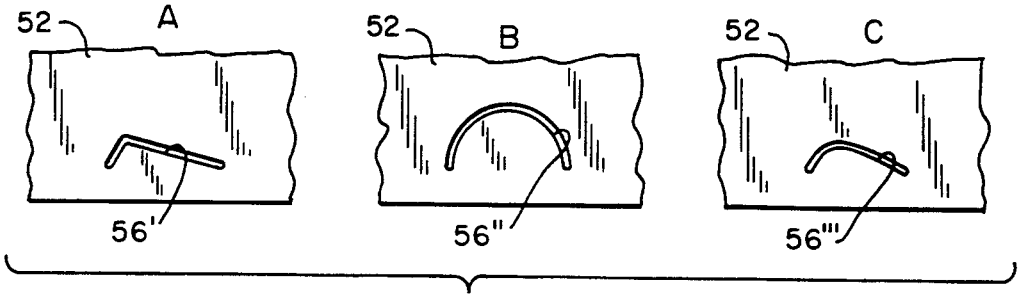
FIGS. 8A, 8B and 8C show different article apertures in the cutting bushings.

Extrusion 21 next enters the cutting assembly 50 which includes a pair of die bushings 52, 54, as seen best in FIGS. 2–4. Bushings 52, 54 are made from two steel plates, preferably hardened steel, that have an article aperture or opening 56 machined therein which corresponds to the cross section of the extrusion 21. Various examples of different shapes 56', 56'', 56''' are shown in FIGS. 8A, 8B and 8C. The dimensions of aperture 56 fit to be somewhat oversized in relation to extrusion 21 so as to allow easy passage of the extrusion without jamming and to allow for some size variation in the extrusion. Front bushing 52 would have a generous entrance radius to help in easy threading of the extrusion 21. Front and/or rear bushings 52, 54 also have a machined recess 35, 57 to accommodate a thin knife blade 58 therein for reciprocable movement; recesses 35, 57 being slightly more than the predetermined knife thickness so that the thin knife or cutting blade 58 can slide between bushings 52, 54 when they are screwed together (see FIG. 3).

Figure 6:
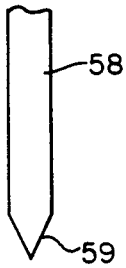
FIG. 6 is a fragmentarily-illustrated end view of the lower portion of the cutting blade taken in the direction of arrow 6 in FIG. 5.
Figure 7:
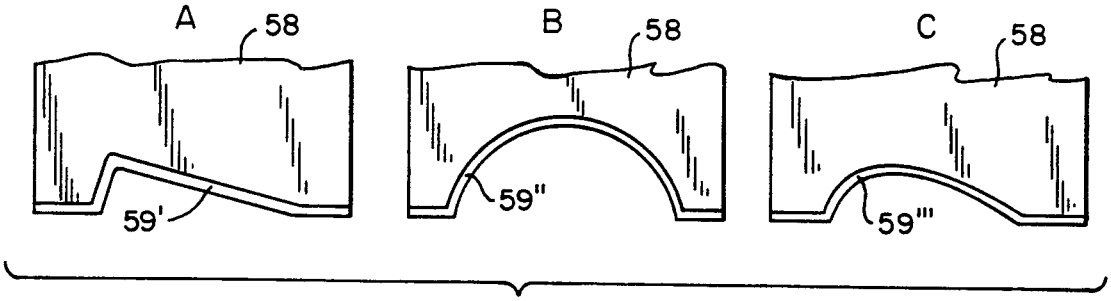
FIGS. 7A, 7B and 7C show different blade profiles.

As seen best in FIG. 6, knife 58 is preferably sharpened to double beveled straight edge 59; in addition to the V-shape, the edge could be hollow ground. It could also be provided with different shapes 59', 59'', 59''' (see FIG. 7) to accommodate different extrusion profiles. The inner die edges of bushings 52, 54 defining aperture 56 do not have any cutting edges. Instead, there they are provided with a slight radius which actually helps the parting action of the cut.

Bushings 52, 54 also have two U-shaped slots 53 in their upper halves. They are a part of a support system which helps prevent the thin cutting blade 58 from buckling during the force of the cut. More particularly, blade 58 is supported by a ram 60, and two side clamp plates 62, each of which have paired, downwardly-projected spaced-apart fingers 63, which fit into the corresponding U-shaped slots 53 of bushings 52, 54. For added rigidity and support, the ram is preferably made integral with one and/or both of the side clamp plates 62.

Figure 9:
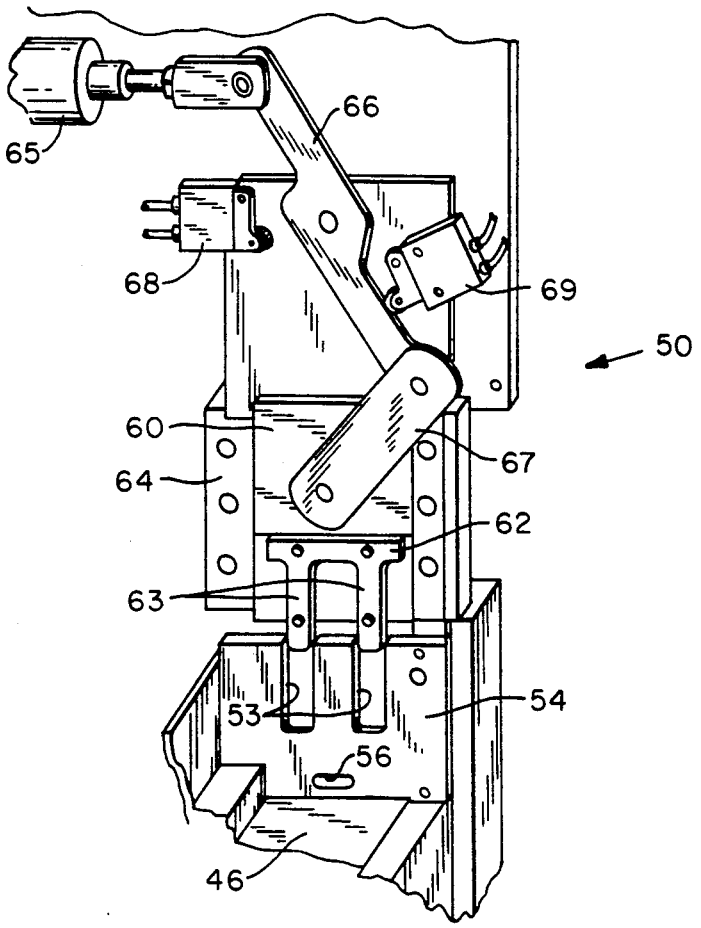
FIG. 9 is an enlarged, isometric rear and side view of the cutter assembly.

As seen best in FIG. 9, ram 60 is reciprocably supported in vertical slide 64 and is activated by an air cylinder 65 through pivot links 66 and 67. Because of the action of the links, only a half cycle of the air cylinder is necessary to create a cut. Two conventional air switches 68 and 69, in effect, signal the machine's computer 90 which way the air cylinder is to fire on the next cut cycle.

As an alternative to the linked drive as shown, an air cylinder could drive ram 60 straight up and down.

Moreover, for higher cycling speed and high power applications, a one revolution clutch could be utilized with an eccentric and link to drive ram 60.

Also, the cutting head could be mounted instead of in its present position, which is over the conveyor belt, slightly in front of the conveyor belt 46 (to its right). This position would allow more operational flexibility. In its present position, the knife 58 can only travel slightly below the bottom of the aperture 56 in the die bushings 52, 54. If it were to travel too far, it would damage the belt which is only about 0.100 of an inch from the bottom of the aperture 56 within die bushings 52, 54.

In the alternate position (to the right of the conveyor belt), since there would be nothing to prevent the knife 58 from travelling further, it would be possible to design knives that cut more gradually by allowing for more travel. Also, the cutting head could possibly be mounted so that the cut occurs from the bottom up instead of the top down as pictured. For some very rigid extrusions, this might be useful depending upon which direction the natural cutting burr occurs. For example, for extrusions that have a Mylar laminate, it is better to have the knife enter the side that is laminated. This usually gives a natural radius to that side after cutting. For a very rigid extrusion, where the laminate is on the bottom, it would be better to have the knife travel from bottom up. On extrusions that aren't extremely rigid, they usually can be twisted 180 degrees between the puller and machine 20 and thus can be cut in a reverse or upside down manner, if desired.

Figure 10:
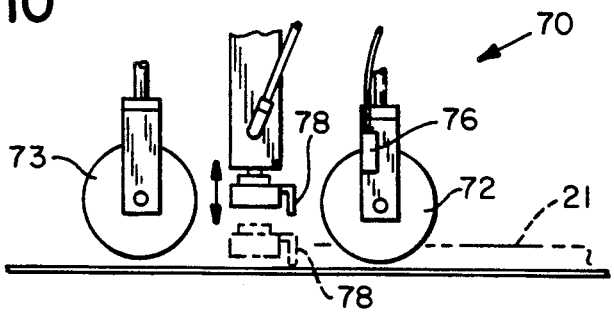
FIG. 10 is an enlarged side elevational view of the dead-stop assembly taken in the direction of arrow 10 in FIG. 11.
Figure 11:
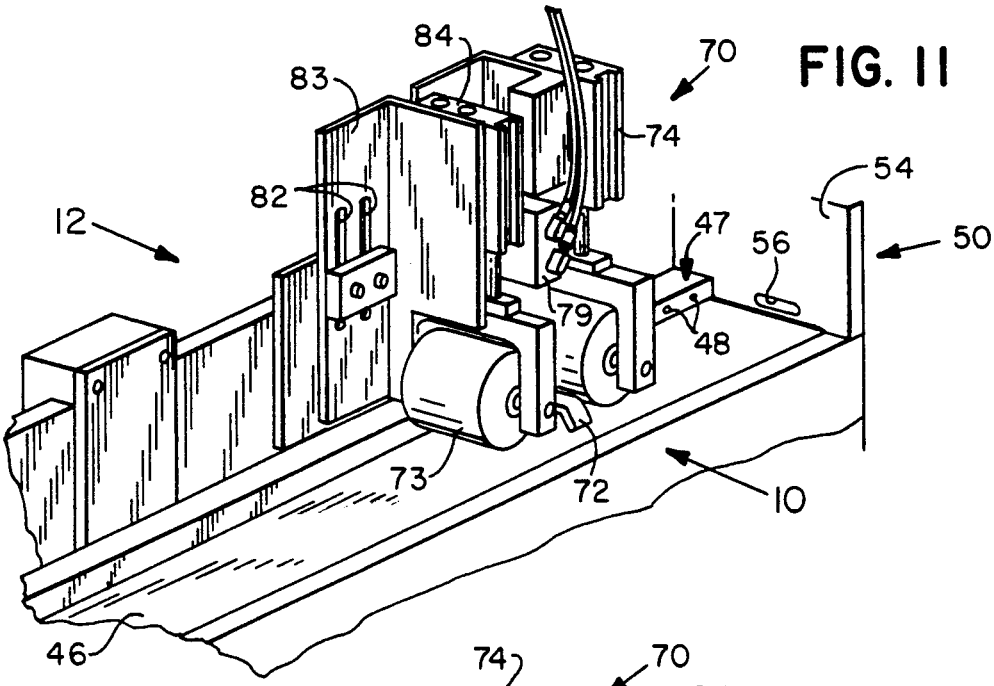
FIG. 11 is an enlarged, isometric rear and side view of the dead stop assembly.

After cutting, the next extrusion 21 enters the dead stop assembly 70, as seen best in FIGS. 1, 10 and 11. Dead stop roller 72 is adjusted so that when the profile 21 passes underneath, it has to lift somewhat (typically from 1/16 to ⅛ of an inch). It receives slight downward pressure from an air cylinder 74. When the extrusion passes underneath, the resulting lift activates a conventional hall effect switch 76. This sends an electrical signal to a conventional computer 90 that controls the machine's operational cycles and which, in turn, then initiates a cut cycle. As an alternative to switch 76, an electric eye or even a mechanical switch could be used to directly sense the presence of extrusion 21. In addition, it should be noted that roller 72 is an idler roller (no turning power of its own). For some extrusions it might be desirable for roller 72 to have its own power in case the conveyor belt doesn't provide enough force to move the extrusion. Therefore, in some versions of this machine, it might be desirable to add a small motor to power roller 72 and possible roller 73 for similar reasons.

Computer 90 has a programmed user adjustable delay after it receives a signal from switch 76. After that delay, pre-feed idler roller 2 is told to lift by the activation of air cylinder 26. Then there is another delay so that the action of roller 72 and the conveyor 46 can push the extrusion 21 the rest of the way to the dead stop 78.

Thus, by lifting roller 24 before the extrusion 21 hits the dead stop 78 and pushing the extrusion 21 by the action of roller 72 and the conveyor 46 a short distance to the dead stop 78, the buckling of the extrusion to the right of the dead stop is prevented. This is extremely important when the machine is used with softer and more flexible extrusions. It should also be noted that during the cut cycle, roller 24 is lifted prior to the actual cut, but rollers 36, 38 serve to prevent the extrusion from backing out of the cutting die.

On more rigid extrusions, roller 24 does not have to be lifted until after the extrusion has already reached the dead stop 78. This condition can be achieved by entering the appropriate delay adjustment in the computer.

Also, height and front guides (not shown) can be added between the cutting die plate 54 and the dead stop assembly 70 to prevent buckling and provide additional guidance. For some extrusions, such as those that have natural curves to them, this might be desirable. After the appropriate delays end, the computer 90 activates air cylinder 65, thereby initiating the cut. After the cut occurs, machine 20 may proceed to handle the cut piece in one of two possible ways. The choice can easily be entered and programmed into the computer by the operator prior to running by picking from a menu displayed upon the computer screen 91.

One of the methods is by blowing the cut piece off the conveyor 46 to the front of the machine. Machine frame 47 has a series of holes 48 that intersect within it at right angles. By screwing an appropriate air fitting in a hole at the top of frame 47, the air is directed out a hole in the side of frame 47, thus blowing toward the front. When in this blow-off mode, dead stop 78 is lifted via the action of air cylinder 79 along with roller 72 by the action of air cylinder 74. Pre-feed roller 24 is brought into its down position via air cylinder 26 (this starts forward movement of extrusion). Also, by operation of appropriate air valve (not shown), air is provided for blowing the product off the conveyor belt 46. The computer can be programmed to time this mode (approximately 0.1 sec.). After this time, the computer signal activates the cylinders for roller 72 and dead stop 78 to bring them into their down positions, thus positioning the same for the next cycle to begin.

It should be noted that the bottom of dead stop 78 is lower than the bottom of roller 72 when they are both in the down position. When they are both in the up position, dead stop 78 is higher than roller 72. Thus, the roller 72 acts as a stripper for the extrusion in case it wants to lift when dead stop 78 is lifted.

The other method of handling the cut piece is by feeding it along the conveyor after cutting (no blowing). In this method, after the cut is performed, only the dead stop 78 is lifted. The action of the turning conveyor 46 and the roller 72 feeds the part down the conveyor. Roller 73 also helps in this regard. Roller 73 is adjustable in height through the slots 82 in its right angle bracket 83. It receives downward adjustable air pressure from air cylinder 84.

The conveyor belt 46 runs at a greater linear speed than provided by the pre-feed assembly 22. Thus, a separation is created between the cut piece and the new end that is on its way to the dead stop assembly 70. Roller 72 will still activate switch 76 while the cut piece remains beneath it. When the separation is under roller 72, roller 72 is sent down by the air pressure in cylinder 74 thus de-activating switch 76. When the computer senses this switch de-activation, it will activate cylinder 79 to drop the dead stop 78 after a small delay (which is to allow the cut piece to completely pass so that dead stop 78 does not drop on top of the cut piece and cause possible damage). Now the machine is ready for the next cycle.

The whole machine can be run in a tilted position, if desired, by providing adjustment brackets (not shown). This is useful if heavy extrusions are to be blown off the conveyor as the angle lets the force of gravity help the air blowing.

Figure 12:
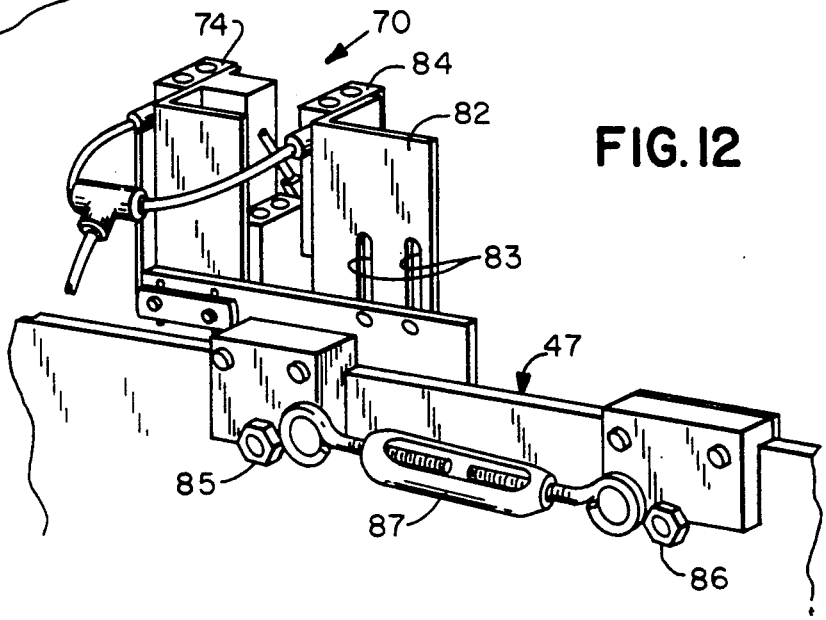
FIG. 12 is an isometric back view of the dead stop assembly and its length adjustment subassembly taken in the direction of arrow 12 in FIG. 11.

As seen best in FIG. 12, for length control and by loosening lock screws 85 and 86, the whole dead stop assembly can be slid on frame 47. By locking screw 86 and loosening screw 85 slightly, the dead stop assembly 70 can be fine tuned for length adjustment by turning turn-buckle 87.

As a result of the foregoing construction, cut-length accuracies are kept tight because of the adjustable-length dead stop assembly 70 located down stream from the cutter head assembly. The type of cutting provides length accuracies of ±0.01 inches or better. Cut squareness and cleanliness is also better than with more conventional cutters. Presently, the machine can cut at lengths from 1 inch to 6 feet at speeds up to 125 pieces per minute. Moreover, the present machine allows the use of thinner cutting blades. Whereas conventional cutting blades have a thickness typically on the order of 0.015 to 0.035 inches, blades having a thickness of 0.006 to 0.012 inches can be used with the present invention.

As can be appreciated, various modifications may be made a will be apparent to those skilled in the art. For example, in another possible embodiment specifically intended for rigid extrusions, the machine could be used with a cutter and dead stop assembly mounted on a linear slide. As a result, there would be no rollers or conveyors or pre-feed assembly, the cutting head and dead stop assembly being modified to be capable of moving together. The amount of movement would be from right to left (if the extrusion enters from the right) would be limited to approximately 1". In this embodiment, the machine would be located as close as practical to the "puller". The machine would be very lightly spring loaded to the right (right to left direction assumed). First the profile would pass through the cutting die (perhaps guides would be necessary in some applications prior to the die). Then it would pass through adjustable side guides (not shown) to give it direction. Top guides could also be added if necessary (for longer lengths that would probably be required). If bottom guides are necessary, they would be attached to air cylinders so that they could be moved out of the way for the cut part ejection which would be in the downward direction.

The dead stop assembly would be attached to an air cylinder so that it can be raised and lowered. Slightly in front of the dead stop assembly there would be a stripper so that the cut piece would not lift when the dead stop assembly is lifted.

When the extrusion hits the dead stop assembly, it will cause the parts of the machine that are on the linear slide, i.e., the dead stop assembly and cutting assembly, to move to the left. This movement will be detected by a switch. The cut cylinder will then be activated. When the cut cylinder completes its cycle, a switch will be activated to cause the dead stop to lift and any bottom guides, if used, to open. Also, air jets aimed downward could now be used to help gravity eject the part. The lifting of the dead stop will activate another switch which will cause, e.g., an air cylinder to return the dead stop and cutting assemblies on the linear slide to their original position. In that position, the switch will be deactivated and the machine will reset waiting for the next cycle to begin. In this version, it is possible to have a machine completely activated by air cylinders. The cutting head would be capable of either being mounted so that it will cut from the bottom up or the top down.

It should also be noted that the computer controls, software and various signal and activation mechanisms (i.e., switches, air cylinders, etc.) per se, are well known in the art and can be substituted with equivalent functional and commercially available parts so long as the same operational relationships and cycles are maintained and performed as described hereinbefore according to the present invention. For example, although the dead stop assembly is mounted in the illustrated embodiment for vertical reciprocable movement, it could instead be mounted for vertical pivotable movement between its operative and inoperative positions. In addition, other configurations for the male-female interlock of the cooperating support fingers and slots could be used and their positions might also be reversed.

Accordingly, while only one embodiment of the present invention has been described and illustrated, it is obvious that many changes and modifications may be made thereunto, without departing from the spirit and scope of the invention.

What is claimed is:

1. A cutter assembly for cutting elongated extruded plastic articles comprising:

a pair of side-by-side, plate-like cutting die bushings having a transverse article opening formed therethrough configured and dimensioned to accommodate passage and guidance of an elongated extruded plastic article therethrough, said cutting die bushings each having an elongated slot formed therein;

a thin, generally planar cutting blade having a cutting edge supportable for reciprocable movement between said cutting die bushings for movement between an operative position in which said blade moves across said article opening so as to cut an article disposed therein and an inoperative position in which said blade is displaced from said article opening; and support means for supporting said cutting blade for reciprocable movement between said operative and inoperative positions thereof, said support means including at least one pair of support fingers, each of which is disposed on an opposite side of said blade spaced from said cutting edge thereof and which is receivable in a respective slot of one of said cutting die bushings to prevent buckling of said blade as said blade moves from said inoperative to said operative position.

2. The cutter assembly of claim 1, wherein said support means has a pair of spaced-apart support fingers disposed on each of opposite sides of said blade and said bushings each having a pair of spaced-apart slots for receiving said pairs of fingers.

3. The cutter assembly of claim 1, wherein said fingers and slots are each generally U-shaped.

4. The cutter assembly of claim 1, wherein said blade has a V-shaped cutting edge.

5. A cutting machine for cutting elongated, extruded plastic articles, comprising:

(a) a cutter assembly including:

(i) a pair of side-by-side, plate-like cutting die bushings having a transverse article opening formed therethrough configured and dimensioned to accommodate passage and guidance of an elongated extruded plastic article therethrough, said cutting die bushings each having an elongated slot formed therein;

(ii) a thin, generally planar cutting blade having a cutting edge supportable for reciprocable movement between said cutting die bushings for movement between an operative position in which said blade moves across said article opening so as to cut an article disposed thereon and an inoperative position in which said blade is displaced from said article opening; and (iii) support means for supporting said cutting blade for reciprocable movement between said operative and inoperative positions thereof, said support means including at least one pair of support fingers, each of which is disposed on an opposite side of said blade spaced from said cutting edge thereof and which is receivable in a respective slot of one of said cutting die bushings to prevent buckling of said blade as said blade moves from said inoperative to said operative position.

(b) feed means disposed in front of said cutter assembly for feeding the plastic articles to and through said article opening of said cutting die bushings;

(c) a reciprocable dead stop means disposed behind said cutter assembly in general alignment with said article opening for movement between an operative position in which it moves into the path of and stops said article and an inoperative position in which it is removed from the path of said article.

6. The cutting machine of claim 5, wherein said feed means comprises a pair of co-acting rotatable feed rollers, one of which is motor driven.

7. The cutting machine of claim 5, additionally including conveyor means for transporting the plastic articles along a predetermined path from said cutter assembly to said dead stop means.

8. The cutting machine of claim 7, additionally including means for removing said articles from said conveyor means.

9. The cutting machine of claim 8, wherein said means for removing comprises air nozzle means for blowing cut articles off said conveyor means.

10. The cutting machine of claim 5, additionally including means for reciprocating said cutting blade and said dead stop means.

11. The cutting machine of claim 10, wherein said means for reciprocating comprises air cylinders.

* * * * *